United States Patent [19]

Mair

[11] Patent Number: 4,498,827

[45] Date of Patent: Feb. 12, 1985

[54] FASTENING DEVICE

[76] Inventor: Bernard Mair, 65 McMorran Crescent, Thornhill, Ontario, Canada, L4J 2T4

[21] Appl. No.: 500,341

[22] Filed: Jun. 2, 1983

[51] Int. Cl.[3] ..... A44B 1/32; F16B 21/08

[52] U.S. Cl. ..... 411/349; 24/691; 24/72.7

[58] Field of Search ..... 24/72.2, 72.5, 72.7, 24/691; 411/349

[56] References Cited

U.S. PATENT DOCUMENTS

| | | | |
|---|---|---|---|
| 2,327,554 | 8/1943 | Purinton | 24/691 |
| 2,826,388 | 3/1958 | Janos et al. | 411/349 |
| 2,900,697 | 8/1959 | Cuss | 411/349 |
| 3,401,908 | 9/1968 | Rapata | 411/349 |
| 3,469,290 | 9/1969 | Andrews | 24/691 |
| 3,849,839 | 11/1974 | Zimber | 411/349 |
| 3,964,364 | 6/1976 | Poe | 411/349 |
| 4,007,516 | 2/1977 | Coules | 411/349 |
| 4,047,266 | 9/1977 | Bisbing | 411/349 |
| 4,378,913 | 4/1983 | Föhl | 411/349 |

FOREIGN PATENT DOCUMENTS

| | | | |
|---|---|---|---|
| 1236407 | 6/1971 | United Kingdom | 24/72.7 |

*Primary Examiner*—Victor N. Sakran

*Attorney, Agent, or Firm*—Swabey, Mitchell, Houle, Marcoux & Sher

[57] ABSTRACT

A fastening device comprises a base portion and a key portion, the base portion having a socket opening therein with a radial shoulder. At least an axial portion of the socket opening is in the form of a regular polyhedron, preferably 12 or 16 sided. The key portion has a furcated post, axial portions thereof being generally conformed to at least portions of the polyhedral socket. The post has a radial shoulder which snaps behind the shoulder of the socket to retain the key in position. As the key is rotated the post interferes in a periodic manner with the socket wall, thereby precluding the key from being accidentally turned. The device may suitably be molded from a resilient thermoplastic resin. The device may also comprise an eye within which the key is received, the eye comprising opposed washer like members the one having serrated posts upstanding therefrom, the other openings for receiving the posts therein in locked relationship.

14 Claims, 7 Drawing Figures

FASTENING DEVICE

FIELD OF INVENTION

This device relates to mechanically operable fastening devices for the retention of removable covers for various objects.

BACKGROUND OF INVENTION

Fastening devices of one type as are commonly used for retaining movable canvas covers or the like comprise a base portion and a key portion upstanding therefrom and mounted for rotation about a central axis. The base portion is provided with a plurality of detents and the key portion with one or more shaped elements which are biased into contact with the detents by a spring. Generally speaking such fastening devices are exposed to the weather, and their structure is such that rain water is channeled into the moving parts, where it collects in the hollow base. This leads to rotting of the underlying support structure and rusting of the fastener components. A further deficiency of the above fasteners resides in the locating mechanism for the key portion. When the key portion is not fully engaged in detents, the biasing spring is compressed. The base structure intermediate the detents is cam like, and the shaped elements of the key portion are urged therealong by the force of the biasing spring. Assuming the key portion to be positioned half-way between adjacent detents, it may then revert to a position wherein it releases the cover.

It is then an object of my invention to provide a fastener device of improved reliability of operation.

It is a further object of my invention to provide a fastener device of simplified structure.

It is yet another object of my invention to provide a fastener device of reduced cost.

SUMMARY OF INVENTION

In a fastener comprising a base portion and a key portion which is rotatably mounted from the base portion by a first member receivable into a socket opening defining a wall member, in accordance with one aspect of my invention, the improvement comprises providing the members with cooperating elements so that as the portions are relatively rotated the interference between the elements varies periodically.

Expediently, the cooperating elements are unitarily formed on the members.

In accordance with a preferred embodiment of my invention the cooperating elements comprise a plurality of axially aligned faces, which may form a closed polygonal figure or a part thereof. Preferably the polygon will be 12 or 16 sided, at least where it is desired that the key be retainable in indexed position at quarter quadrant intervals or multiples thereof. Whether other intervals are desired the number of sides of the polygon may be appropriately varied.

The cooperating elements will be of a resilient nature and materials of construction having an inherent elasticity such as thermoplastics are preferred. As a complementary or supplementary measure, the cooperating elements may be formed so as to be resiliently movable, for example by furcating the post whereby opposed sides thereof will move inwardly as the interference between the cooperating elements increases.

In accordance with a still further aspect of my invention the members are provided with cooperating radial shoulders which engage the one behind the other to lock the post within the socket opening.

Having described the salient features of my invention, it will be further described in relation to a preferred embodiment thereof, from which still further features, objects and advantages will become apparent.

DESCRIPTION OF THE PREFERRED EMBODIMENTS

Figure 1:
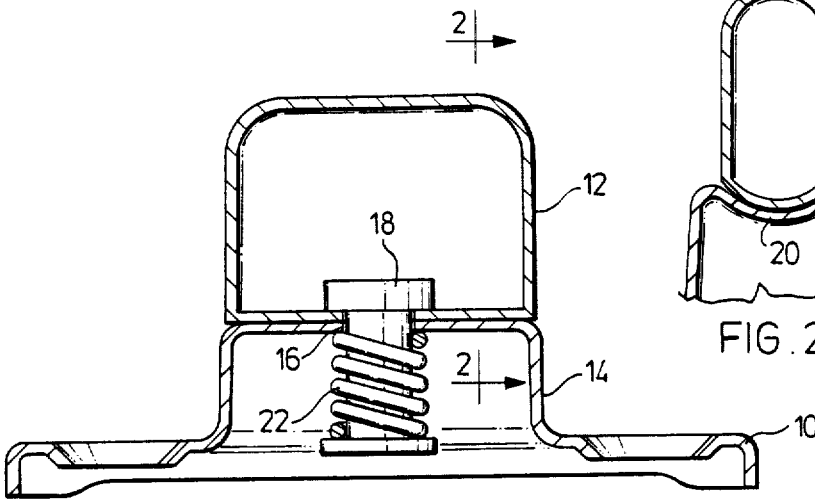
FIG. 1. PRIOR ART
FIG. 1 shows a fastening device of the prior art in longitudinal cross section.
Figure 2:
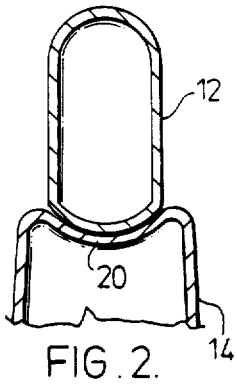
FIG. 2 is a section on 2—2 of FIG. 1.

Referring now to the Figures in detail, a fastener produced in accordance with the current state of the art comprises a base 10 and a key 12. Base 10 is struck from sheet metal and is jumped up at 14 to form a crown having an opening 16 in the upper surface thereof. A post 18 is integrally connected to key 12 to project through opening 16 to the underside of crown 14. The upper generally horizontal surface of crown 14 is provided with a longitudinal detent 20 and a transverse detent (not seen) into which key 12 is urged by a spring 22. When key 12 engages a detent in crown 14, the key is in a stable position. If key 12 is only partly rotated, so that it is not engaged in a detent, it assumes a metastable position. Spring 22 will then tend to rotate key 12, which could accidentally revert to an unlocked position.

The detents in crown 14 naturally funnel water draining down key 12 into opening 16, and it tends to collect beneath hollow base 10 serving to rot any substructure such as wood or canvas to which the base may typically be secured, and to rust spring 22.

Figure 3:
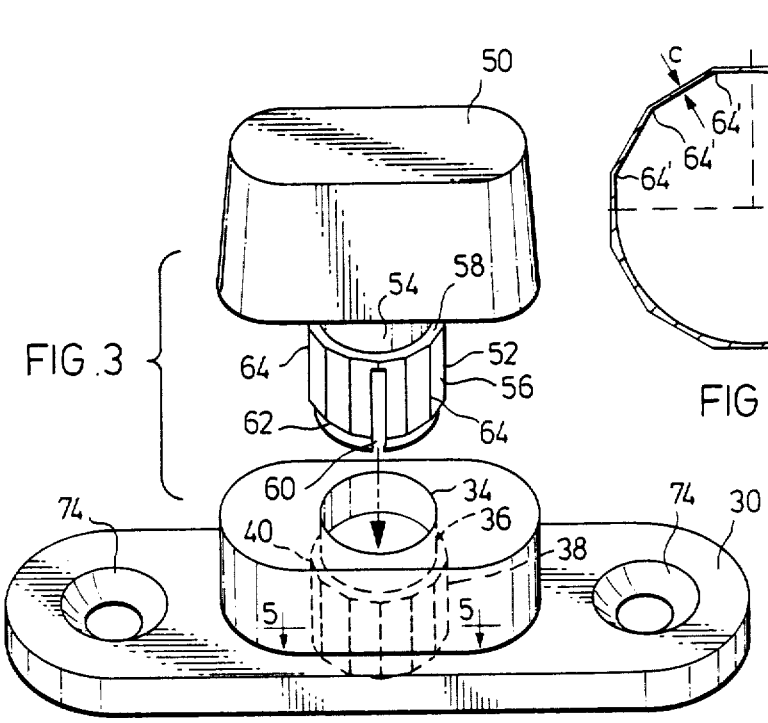
FIG. 3 shows a fastening device constructed in accordance with my invention in exploded isometric view.
Figure 4:
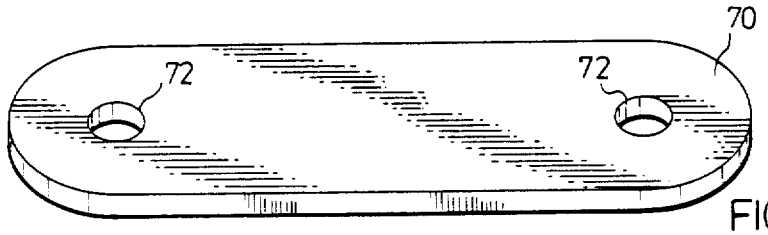
FIG. 4 shows a counter plate which may be used to secure the fastening device of FIG. 3.

With reference to FIGS. 3 and 4 of the drawings, a fastening device constructed in accordance with my invention comprises a base 30 having an elongated central portion 32 raised therefrom. Central portion 32 has a socket 34 therein in communication with the upper and lower surfaces thereof. Socket 34 has an upper axial portion 36 which enlarges to a lower axial portion 38 at a radial shoulder 40. The lower axial portion 38 has a regular dodecahedral cross section whilst the cross section of upper axial portion 36 is conveniently circular. The fastening device further comprises a key 50. Key 50 has a post 52 projecting downwardly therefrom, the post having an upper portion 54 and a lower portion 56 separated by a radial shoulder 58. The cross sectional shape of post portions 54 and 56 is generally identical to that of the corresponding portions of socket 34, and the cross sectional dimensions are generally identical so as to create a slight interference with the socket wall when the post is received therein. The radial dimensions of socket 34 will be such as to permit post portion 56 to be forced through upper socket portion 36 without damage, and permit shoulder 58 to engage behind should 40.

For this purpose post 52 is furcated at 60, which will permit the post to deform resiliently. Preferably both base 30 and key 50 are moulded from a thermoplastic resin material having a moderately high modulus of elasticity and a good elastic memory, such as nylon, which will permit an elastic deformation of socket walls 36 as post portion 56 passes therealong. To assist in the assembly process, the lower peripheral edge of post 52 is chamfered at 62.

The axial dimensions of the portions of post 52 are not critical, although the length of upper post portion 54 will be marginally greater than the length of upper socket portion 36, whereby the bottom surface of key 50 will not unduly interfere with the upper surface of central portion 32 when the key is engaged in base 30. The axial length of lower portion 56 of post 52 will, to a considerable degree, determine the resistance to the rotation of key 50 in base 30. As key 50 is turned, the ridges 64 at the intersection of the side faces of lower post portion 56 move into strong interference with the side faces of lower socket portion 38. For a dodecahedral socket structure as here, the interference will vary periodically through a maximum with each 30° of rotation; similarly for a hexadecahedral structure the maximum will occur at 22.5° intervals so as to provide 3 and 4 maxima respectively for each 90° of rotation of key 50.

Figure 5:
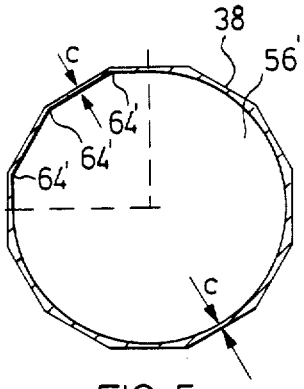
FIG. 5 is a transverse section on 5—5 of FIG. 3 of a second embodiment of the assembled device.

The degree of interference is controllable by other factors, including the stiffness of the materials of construction of the post 52 and base 30 and the precise design factors. Thus the walls of post 52 will tend to hinge inwardly about the upper ends of furcations 60, hence their number, depth and width may all be varied to provide a suitable degree of interference, or, put another way, resistance to turning of key 50. With reference to FIG. 5, yet a further method of controlling the resistance to rotation of key 50 is illustrated. In this embodiment, socket portion 38 is again a regular polyhedral shape. However, post portion 56' has a circular section over three quadrants thereof, the fourth quadrant, shown as being enclosed within the dashed lines, being shaped in conformity with sides of the polyhedron adjacent thereto. Whilst a clearance C is shown between the wall portions of lower post portion 56' and mid portions of each polyhedral face of socket portion 38 adjacent thereto, this is for the purpose of clarity only, and normally the circular portion would be just tangential to the midface portions of the polyhedral faces, which is to say that the clearance C would be zero. The circular portions of post portions 56' would then provide good lateral location for the post within opening 34, without generating any significant resistance to the rotation of the post. Resistance would be generated only by the interference of the ridges 64' with the sides of the polygonal opening in the same manner as the previously described. The resistance could still further be diminished by rounding the ridges 64'.

Figure 6:
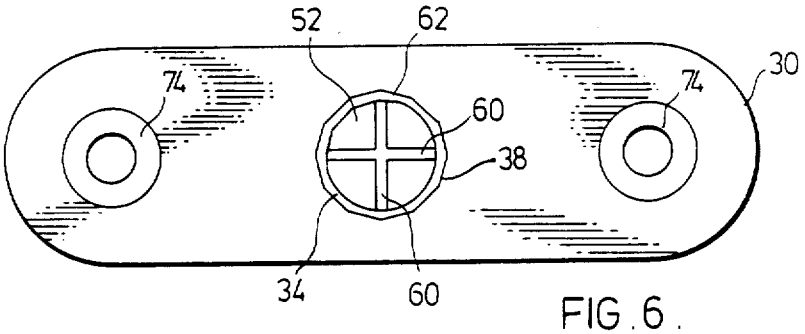
FIG. 6 is a plan view of the device of FIG. 3 from below.

Referring particularly to FIG. 6, it will be seen that the underside of base 30 is essentially solid, whereby no opportunity is provided for water to collect beneath the base. Whilst socket 34 communicates with the underside of base 30, this is only as a matter of expediency in the process of molding the base, and the socket may be blind so as to prevent water drainage therethrough. It may also be remarked that the head of key 50 will act to direct water away from socket 34 rather than into the socket, as in the prior art. The generally solid nature of base 30 permits the base to be more rigidly mounted on support surfaces, especially where the fastening devices is mounted on a pliable material such as canvas. For this purpose I provide a solid counter plate, identified in FIG. 4 by the numeral 70. Counter plate 70 has a pair of spaced apart openings 72 therein, with corresponding openings 74 being provided in base 30, the base and counter plate typically being secured together by hollow rivets. Of course, where base 30 is to be mounted on a solid surface, counter plate 70 may be dispensed with, and base 30 secured directly to the solid surface with screws or the like passing through openings 74.

Figure 7:
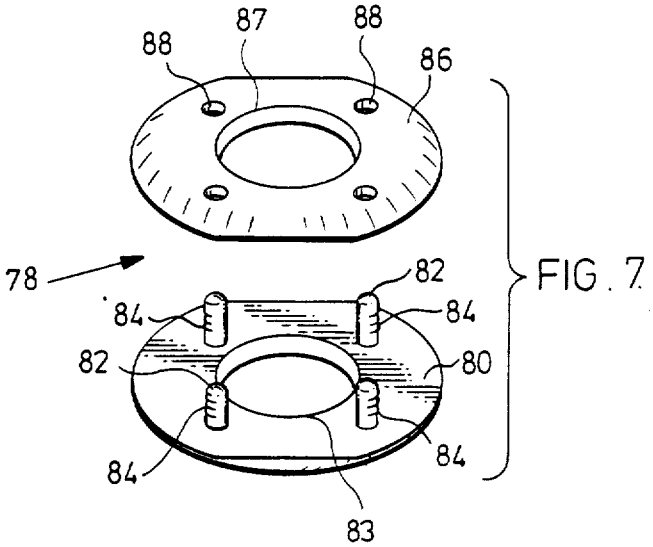
FIG. 7 is an exploded isometric view of a second component of the fastening device of my invention.

Fasteners of the prior art comprise an eye portion into which the key is receivable and lockable. Generally the eye portion comprises opposed washers, the one having tangs which pierce the canvas or other fabric material to which the eye portion is secured, and which are upset over an edge of the other washer to secure the eye in position. In accordance with a further aspect of my invention, and with specific reference to FIG. 7, I provide an eye portion 78 which comprises a one washer 80 having tangs 82 upstanding therefrom surrounding a central opening 83, each tang having serrations 84 formed along a major edge thereof. Eye portion 78 comprises a second washer 86 having a central opening 87 therein and small openings 88 therein located so as to be matable with respective ones of tangs 82. One or both of the materials or material from which tangs 82 and the walls defined by openings 88 is elastically resilient so as to permit an elastic deformation as serrations 84 pass through openings 88, whereby a shoulder of a serration of each tang will snap behind a major surface portion of washer 86 adjacent each opening 88 to clamp the washers together and so secure them to a fabric material base. Expediently and preferably as in this embodiment, washers 80 are moulded from a thermoplastic resin and tangs 82 are formed unitarily therewith.

It will be apparent that other variations of my invention which differ to a greater or lesser degree from the above described illustrated embodiments may well be made, and that under specific circumstances they may be preferred. The scope of my invention is not then to be limited to the above described illustrative embodiments, but according to the spirit of the claims appended hereto.

I claim:

1. A fastening device comprising:

a base portion and a key portion;

one said portion including a post member, the other a wall member defining an axially extending bore opening therein mounting said post member for rotation about its axis;

said members being provided on the axial wall surfaces thereof with cooperating elements so that as said portions are relatively rotated a radially compressive force is periodically generated between said elements, and means retaining said post member within said socket opening.

2. The device of claim 1, wherein said cooperating elements are unitarily formed on said members.

3. The device of claim 1, wherein said means comprises cooperating radial shoulders formed on said members.

4. The device of claim 1, 2, or 3, wherein said post member is furcated.

5. The device of claim 1, 2, or 3, wherein said cooperating elements comprise a plurality of axially aligned facets.

6. The device of claim 1, 2 or 3, wherein said cooperating elements comprise a plurality of axially aligned facets which form at least a part of a regular closed polygonal figure.

7. The device of claim 1, 2 or 3, wherein said cooperating elements form at least in part a regular polygonal figure having 12 or 16 sides.

8. The device of claim 1, 2, or 3, including a counter plate, and wherein said base and said counter plate include means for securing them together.

9. The device of claim 1, 2 or 3, including a receiving number for said key, comprising opposed plate like members, each having an elongated central opening therein through which said key is insertable, one said plate like member being provided with a plurality of smaller openings therein surrounding said central opening, the other a plurality of serrated tangs projecting therefrom so as to be matable with respective ones of said smaller openings.

10. A fastening device comprising:

a base portion having an axially extending bore therein, the axial wall of said bore being formed with a plurality of axially aligned facets forming at least part of a regular polygon having 12 or 16 sides;

a key portion having a post member, said post member mounting said key portion for rotation in said bore, said post member having a plurality of axially aligned facets thereon which cooperate with the facets of said bore whereby as said base portion and said key portion are relatively rotated, said facets move into and out of coincidence, thereby causing a periodical radially compressive interference between said base portion and said key portion; and means for retaining said key portion in an axially fixed position with respect to said base member.

11. A fastening device as defined in claim 10, wherein said facets of said base portion form a complete polygon.

12. A fastening device as defined in claim 11, wherein the facets of said post member form a complete regular polygon.

13. A fastening device as defined in claim 10, 11 or 12, wherein said post is axially furcated to reduce the radially compressive interference between said elements.

14. A fastening device as defined in claim 10, 11 or 12 wherein said means for retaining said key portion in an axially fixed position comprises cooperating radial shoulders on said key portion and said base portion.

* * * * *